9/26/78 XR

United States Patent [19]

Liou Tchen San

[11] 4,117,467

[45] Sep. 26, 1978

[54] TAMPER RESISTANT ALARM ANNUNCIATOR

[76] Inventor: René Liou Tchen San, 10 rue Kellog, Suresnes, France

[21] Appl. No.: 814,401

[22] Filed: Jul. 11, 1977

[30] Foreign Application Priority Data

Jul. 21, 1976 [FR] France ..... 76 22183

[51] Int. Cl.[2] ..... G08B 29/00

[52] U.S. Cl. ..... 340/506; 340/566; 340/568; 340/653; 340/693

[58] Field of Search ..... 340/421, 409, 276, 280; 200/DIG. 8

[56] References Cited

U.S. PATENT DOCUMENTS

| | | | |
|---|---|---|---|
| 667,115 | 1/1901 | Coleman | 340/276 |
| 735,324 | 8/1903 | Weatherby, Jr. | 340/276 |
| 880,668 | 3/1908 | Jones | 340/276 |
| 2,627,065 | 1/1953 | Poulson | 340/276 |

*Primary Examiner*—Glen R. Swann, III
*Attorney, Agent, or Firm*—Barry Kramer

[57] ABSTRACT

A tamper-resistant box for protecting the hooters of burglar and fire alarm systems. The box has a fixed frame to be attached to a support, such as a building, and a moveable cover separated slightly from the frame by interposed springs. Microinterrupters are sensitive to any movement of the moveable cover relative to the frame to energize the hooter when the moveable cover is touched.

6 Claims, 5 Drawing Figures

Fig. 2
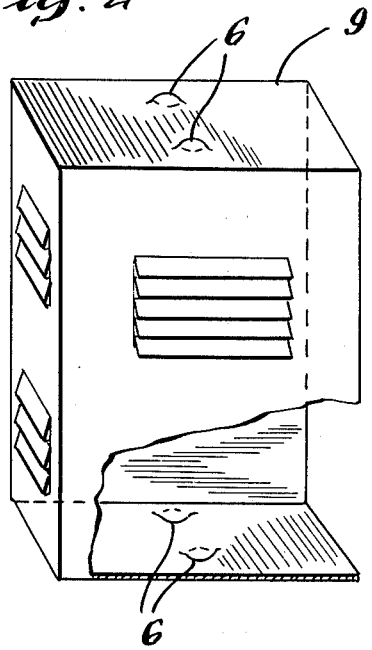
Fig. 1.
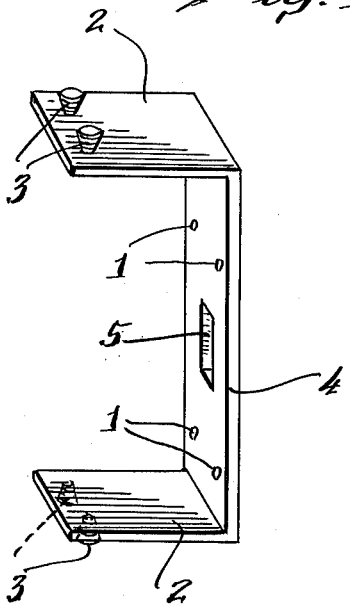
Fig. 3.
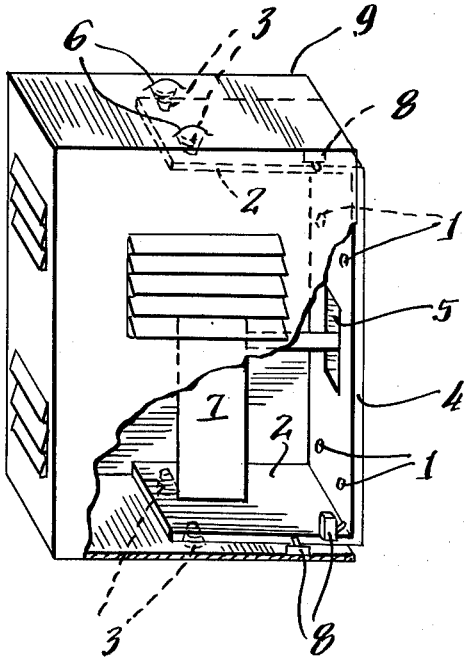
Fig. 4.
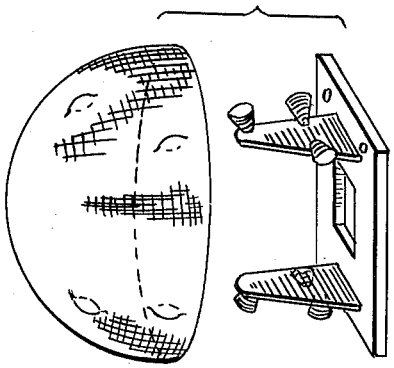
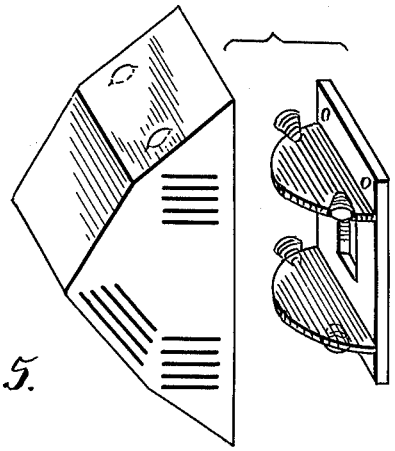
Fig. 5.

TAMPER RESISTANT ALARM ANNUNCIATOR

BACKGROUND OF THE INVENTION

Metal boxes are used to protect hooters from being tampered with. These boxes have openings for propagating the sound produced by the hooters.

In burglar or fire alarm systems, the hooters are usually outside the detection zone and the metal boxes protecting them are fixed with them onto the outside walls or roofs of the protected buildings. These boxes are usually equipped with microinterrupters which cause the hooter to be energized when an attempt is made to tear off the box.

Sabotage is often attempted by sealing off the openings, thus considerably or totally attenuating sound produced by the hooters. Present boxes are not resistant to this type of tampering.

SUMMARY OF THE INVENTION

The present invention is a new metal or rot-proof plastic box which causes energization of a hooter (or other warning signals of a classical alarm system) as soon as an attempt is made to remove the box or to apply a semiliquid or solid product on any one of its exterior sides.

DESCRIPTION OF THE DRAWINGS

While the specification concludes with claims particularly pointing out and distinctly claiming that which is regarded as the present invention, further details of preferred embodiments of the invention may be more readily ascertained from the following description, read in conjunction with the accompanying drawings wherein:

FIG. 1 is a partially cut away view of a frame for the box;

FIG. 2 is a perspective view of a moveable cover for the box;

FIG. 3 is a partially cut away perspective view of the box with the cover in place; and FIGS. 4 and 5 illustrate alternate embodiments of the cover and frames.

DESCRIPTION OF PREFERRED EMBODIMENTS

FIG. 1 shows the frame or fixed part of the new box. The frame has anchor holes 1 for receiving mounting bolts (not shown), horizontal supports 2 on which are fixed springs 3 which resiliently support a moveable cover 9 (FIG. 2). A thick rigid base section 4 of the frame allows the moveable cover 9 to move forwards and backwards relative to frame as soon as any pressure is exerted on the front of cover 9. The base section 4 has a thickness varying between 5 and 30 mm. A main opening 5 is used for passing the anchor and connections of the hooter.

The frame dimensions are less than those of the moveable cover 9 of the box, the difference between them determining the limits of lateral and vertical movements of the moveable cover as controlled by the interposed springs. The separation between the frame and cover may vary from 10 to 100 mm. FIG. 2 shows the moveable cover 9 of the new box, the sides of which may have openings permitting the propagation of alarm sounds. The top and bottom surfaces of the cover have no openings but do have bosses 6 which receive the ends of the springs to resiliently support the cover 9 in slightly spaced relation to the frame. That is, the cover 9 can be said to float on the springs. FIG. 3 shows the new box with a hooter 7 and microinterrupter contacts. The details of the microinterrupter are not disclosed as these may be conventional. Such details are not a part of the present invention.

It is evident that various forms may be used for the moveable cover as well as for the frame. These are given as non-limiting examples in FIGS. 4 and 5. FIG. 4 shows a cover made of open metalwork or metal mesh. FIG. 5 shows an elliptic box and a complementary frame: These and other cover and frame shapes may be used in place of the rectangular box described in FIGS. 1–3.

The new protective box is composed of a fixed frame and a "floating" moveable cover protecting the hooter. Any attempt to sabotage the hooter by applying semiliquid or sclid products on the exterior of the moveable cover will cause vertical or horizontal movement of the cover relative to the frame. These movements interrupt the microinterrupter contacts which immediately causes the hooter to be energized.

The new box may be used without difficulty in all burglar or fire alarm systems to protect hooters either outside or inside the detection zone. It considerably increases the quality of those systems which require that the alarm be tamper-proof.

This new box may also be used to protect electronic stations, control or warning apparatuses.

While there have been described what are considered to be preferred embodiments of the invention, it is obvious the variations and modifications will occur to those skilled in the art once they become acquainted with the basic concepts of the invention. Therefore, it is intended that the appended claims shall be construed as including all such variations and modifications as fall within the true spirit and scope of the invention.

What is claimed is:

1. A tamper-resistant box for an alarm annunciator comprising a frame adapted to be secured to a support, a moveable cover, a plurality of resilient elements interposed between said frame and said cover for resiliently supporting said cover in slightly spaced relation from said frame, and at least one microinterrupter position to be responsive to movement of the cover relative to the frame to energize the alarm annunciator.

2. A tamper resistant box as recited in claim 1 wherein said resilient elements are springs.

3. A tamper resistant box as recited in claim 2 wherein the springs are coil springs, each having one end attached to said frame and the other end received in a boss in said cover.

4. A tamper resistant box as recited in claim 1 wherein the cover is larger than the frame.

5. A tamper resistant box as recited in claim 1 wherein said cover has openings for propagating sound generated by the alarm annunciator.

6. A tamper resistant box as recited in claim 4 wherein the alarm annunciator comprises a hooter.

* * * * *

UNITED STATES PATENT OFFICE

CERTIFICATE OF CORRECTION

Patent No. 4,117,467 Dated September 26, 1978

Inventor(s) Rene' Liou Tchen San

It is certified that error appears in the above-identified patent and that said Letters Patent are hereby corrected as shown below:

IN THE TITLE:

"TAMPER RESISTANT ALARM ANNUNCIATOR" should read

--TAMPER RESISTANT ALARM ANNUNCIATOR BOX--.

Signed and Sealed this

*Nineteenth* Day of *December 1978*

[SEAL]

*Attest:*

RUTH C. MASON
*Attesting Officer*

DONALD W. BANNER
*Commissioner of Patents and Trademarks*